US009051725B2

(12) United States Patent
Farmer

(10) Patent No.: US 9,051,725 B2
(45) Date of Patent: Jun. 9, 2015

(54) PORTABLE BUILDING

(71) Applicant: James Bert Farmer, Orangeville (CA)

(72) Inventor: James Bert Farmer, Orangeville (CA)

( * ) Notice: Subject to any disclaimer, the term of this patent is extended or adjusted under 35 U.S.C. 154(b) by 0 days.

(21) Appl. No.: 14/255,289

(22) Filed: Apr. 17, 2014

(65) Prior Publication Data

US 2014/0311052 A1 Oct. 23, 2014

Related U.S. Application Data

(60) Provisional application No. 61/813,300, filed on Apr. 18, 2013.

(51) Int. Cl.
*E04B 1/343* (2006.01)
*E04B 1/344* (2006.01)

(52) U.S. Cl.
CPC ..... *E04B 1/34357* (2013.01); *E04B 1/34384* (2013.01); *E04B 1/3442* (2013.01)

(58) Field of Classification Search
CPC ..... E04B 7/163; E04B 7/166; E04B 1/344; E04B 1/344305; E04B 1/3445; E04B 1/3205; E04B 1/3441; E04B 1/3442; E04B 1/3444; E04B 1/34357; E04B 1/34384; E04B 1/34321; E04B 1/1205
USPC ..... 52/79.1, 79.5, 64, 66, 67, 632, 645, 52/646; 135/143, 144, 145, 139
See application file for complete search history.

(56) References Cited

U.S. PATENT DOCUMENTS 1,170,188 A * 2/1916 Rasmussen et al. ..... 135/149
2,603,171 A * 7/1952 Smith ..... 52/66
2,827,138 A * 3/1958 Roy, Jr. ..... 52/86
3,028,872 A * 4/1962 Cresswell ..... 135/94
3,092,126 A * 6/1963 Smith ..... 135/139
3,749,107 A * 7/1973 Laberge ..... 135/137
3,890,747 A * 6/1975 Van Der Lely ..... 52/64
4,027,912 A * 6/1977 Pacca ..... 296/160
4,150,682 A * 4/1979 Ryce ..... 135/130
RE30,044 E * 7/1979 Huddle ..... 52/63
4,527,362 A * 7/1985 Tobey et al. ..... 52/71
4,649,947 A * 3/1987 Tury et al. ..... 135/97
4,829,726 A * 5/1989 de Potter d'Indoye ..... 52/66
4,844,109 A * 7/1989 Navarro ..... 135/129
5,263,507 A * 11/1993 Chuang ..... 135/140
5,331,777 A * 7/1994 Chi-Yuan ..... 52/64
5,493,818 A * 2/1996 Wilson ..... 52/71
5,634,638 A * 6/1997 Havens et al. ..... 473/421
5,839,462 A * 11/1998 Randall ..... 135/128
5,960,593 A * 10/1999 Murphy ..... 52/79.5
6,026,613 A * 2/2000 Quiring et al. ..... 52/63
6,085,468 A * 7/2000 Quiring et al. ..... 52/63
6,321,501 B1 * 11/2001 Ignash ..... 52/645
6,434,895 B1 * 8/2002 Hosterman et al. ..... 52/143
6,550,491 B1 * 4/2003 Bixler et al. ..... 135/145
6,679,009 B2 * 1/2004 Hotes ..... 52/86
6,763,633 B2 * 7/2004 Cote ..... 52/71
6,952,900 B2 * 10/2005 Leurent ..... 52/86
7,185,667 B2 * 3/2007 Rottmann ..... 135/142

(Continued)

*Primary Examiner* — James Ference

(74) *Attorney, Agent, or Firm* — Gowling Lafleur Henderson LLP; Jeffrey W. Wong

(57) ABSTRACT

A portable building including a set of walls, namely a rear wall, a front wall and a pair of side walls, and a set of trusses, engaged with the side walls which assist the portable building being able to transition between a collapsed transport condition and an assembled condition. The portable building further includes a roof portion that mounts over the set of trusses.

7 Claims, 13 Drawing Sheets

(56) References Cited

U.S. PATENT DOCUMENTS

| | | | | |
|---|---|---|---|---|
| 7,520,091 | B2 * | 4/2009 | Friedman | 52/63 |
| 7,584,763 | B2 * | 9/2009 | Yoon | 135/131 |
| 7,735,502 | B1 * | 6/2010 | Hotes | 135/91 |
| 7,886,757 | B2 * | 2/2011 | Hotes | 135/122 |
| 7,980,029 | B2 * | 7/2011 | Ahmedy | 52/71 |
| 8,082,700 | B2 * | 12/2011 | Kennedy et al. | 52/86 |
| 8,136,306 | B2 * | 3/2012 | Scheps | 52/67 |
| 8,209,937 | B2 * | 7/2012 | Scheps | 52/747.1 |
| 2002/0108646 | A1 * | 8/2002 | Hotes | 135/124 |
| 2003/0000154 | A1 * | 1/2003 | Ignazio | 52/66 |
| 2003/0041548 | A1 * | 3/2003 | Merrifield | 52/646 |
| 2005/0108955 | A1 * | 5/2005 | Howe et al. | 52/79.5 |
| 2007/0044415 | A1 * | 3/2007 | Merrifield et al. | 52/633 |
| 2007/0051054 | A1 * | 3/2007 | Devincenzo et al. | 52/72 |
| 2008/0257394 | A1 * | 10/2008 | Tseng | 135/124 |
| 2008/0283107 | A1 * | 11/2008 | Hotes | 135/124 |
| 2009/0158673 | A1 * | 6/2009 | Friedman | 52/66 |
| 2009/0217600 | A1 * | 9/2009 | De Azambuja | 52/79.5 |
| 2010/0126545 | A1 * | 5/2010 | Bullivant et al. | 135/125 |
| 2011/0308173 | A1 * | 12/2011 | Forsland et al. | 52/67 |
| 2012/0000141 | A1 * | 1/2012 | Forsland et al. | 52/66 |
| 2012/0031013 | A1 * | 2/2012 | Scheps | 52/67 |
| 2012/0090250 | A1 * | 4/2012 | Moscovitch | 52/68 |
| 2012/0131858 | A1 * | 5/2012 | Hosking et al. | 52/6 |
| 2012/0131859 | A1 * | 5/2012 | Hosking et al. | 52/6 |
| 2012/0131860 | A1 * | 5/2012 | Hosking et al. | 52/8 |
| 2012/0131861 | A1 * | 5/2012 | Hosking et al. | 52/8 |
| 2012/0180404 | A1 * | 7/2012 | Scouten | 52/79.5 |
| 2012/0285104 | A1 * | 11/2012 | Digregory | 52/79.5 |
| 2012/0291363 | A1 * | 11/2012 | Forsland et al. | 52/67 |
| 2012/0325279 | A1 * | 12/2012 | Munoz | 135/93 |
| 2013/0014793 | A1 * | 1/2013 | Gerengi | 135/96 |

* cited by examiner

PORTABLE BUILDING

CROSS-REFERENCE TO RELATED APPLICATIONS

This application claims the benefit of priority of U.S. Provisional Patent Application No. 61/813,300 filed Apr. 18, 2013, which is hereby incorporated by reference.

FIELD OF THE DISCLOSURE

Generally, the present disclosure provides a portable building. More specifically, the disclosure is directed at a portable transportable clear span building with a capability for a large door opening.

BACKGROUND OF THE DISCLOSURE

Portable buildings are a building designed and built to be movable rather than permanently located. The portable building may provide certain advantages including allowing an owner to sell a building to any buyer who is travelable over road, rather than having to find a buyer in the locale where the building was originally erected. As well, portable buildings allow a purchaser to merely move the building when moving to a new location, rather than having to sell a fixed building and erect a new building at the new location. Portable buildings allow for ease of transport so that the buildings may follow mobile sites such as construction sites, disaster aid sites, military operational sites and sites that require temporary protection such as archaeological sites or crime scenes.

A particular type of portable building is one that is collapsible or foldable. A collapsible or foldable building may allow for easier transport; for example, not requiring an oversized load requirement in North America, not requiring specialized transport vehicles and not requiring large transporting expenses. Conventional collapsible or foldable buildings are typically taken apart prior to transport. This may require a lot of time, knowhow or expertise to assemble and disassemble due to the typically large and complex nature of a building. As well, assembling a conventional portable building may raise safety concerns if the complex assembly was not performed correctly.

SUMMARY

In a first aspect, the present disclosure provides a portable building able to transition between a collapsed transport condition and an assembled condition, the portable building including a rear wall; a pair of side walls attached to the rear wall, the side wall including a hinged wall section, an end section, a side folding mechanism intermediate the hinged wall section and the end section for folding the hinged wall section along the end section; a front wall comprising a pair of outer doors; a pair of front folding mechanisms intermediate the outer doors and the respective side walls for folding each outer door along the respective side wall; a plurality of sliding roof trusses slidably engaged with the pair of side walls such that the plurality of sliding roof trusses can slide from a dispersed state along the pair of side walls to a collapsed state; and a roof mounted over at least a portion of the plurality of sliding roof trusses.

In another aspect, there is provided a method of collapsing a portable building for transport, the method including folding a pair of outer doors of a front wall along a first side wall and a second side wall respectively; sliding 'sliding roof trusses' along the first and second side walls from a dispersed state to a collapsed state; folding a first hinged wall section of a first side wall along a first end section of the first side wall; and folding a second hinged wall section of a second side wall along a second end section of the second side wall.

Other aspects and features of the present disclosure will become apparent to those ordinarily skilled in the art upon review of the following description of specific embodiments in conjunction with the accompanying figures.

DETAILED DESCRIPTION OF THE DISCLOSURE

The disclosure is directed at an apparatus for a portable building 10 which may be transportable and may be erected as long as there is a large enough tract of land available to receive the footprint of the portable building 10.

Figure 1:
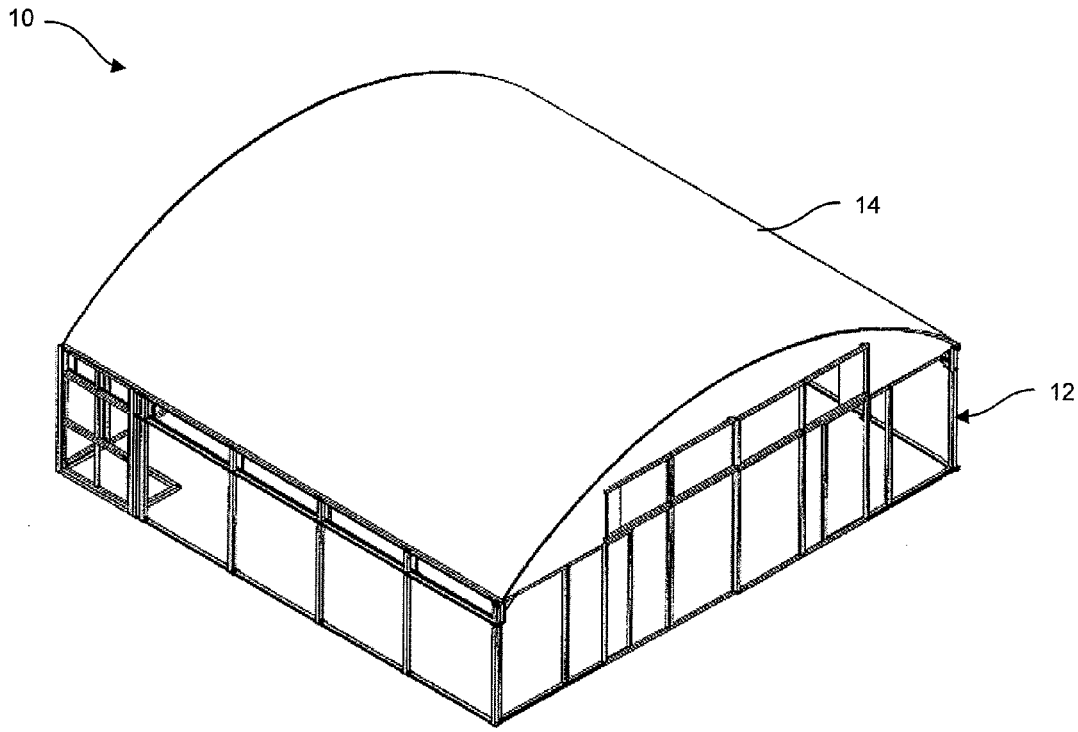
FIG. 1 is a perspective view of a portable building in an assembled condition according to an embodiment.

Turning to FIG. 1, a perspective view of a portable building 10 is shown in an assembled condition. The portable building 10 includes a frame 12 which forms a set of walls and support for a roof 14. The roof 14 is preferably made of a foldable material such as, but not limited to, fabric. In the current figure, the portable building 10 is shown in a closed position and has been erected at a specific location.

Figure 2:
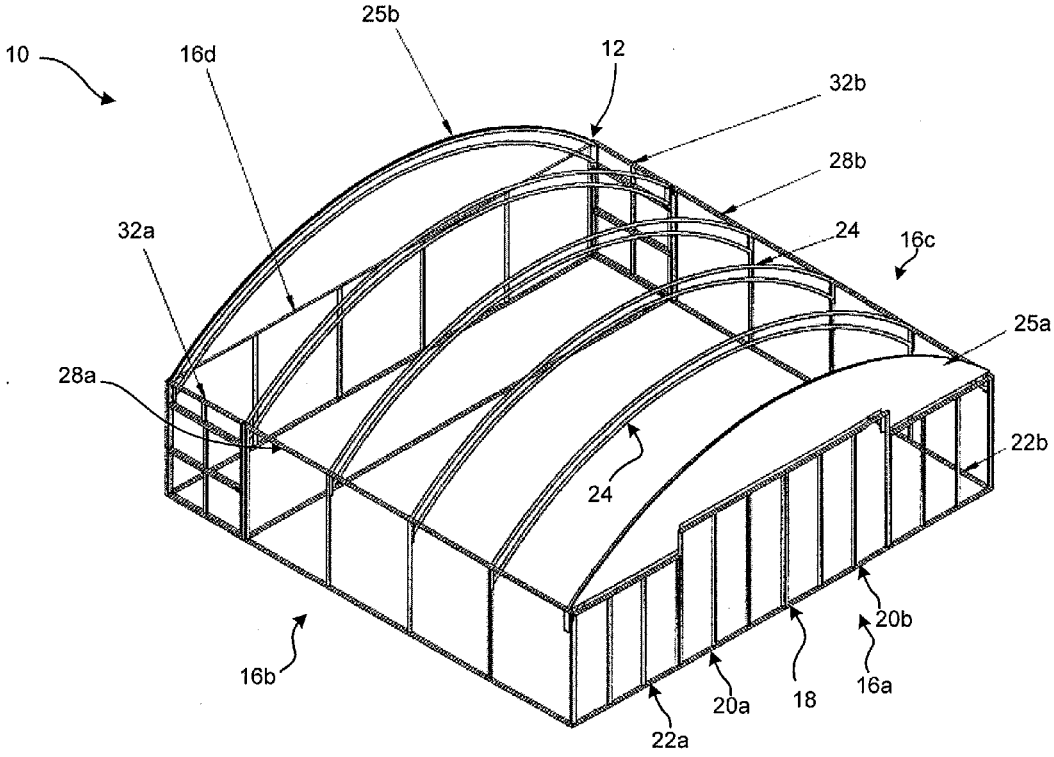
FIG. 2 is a perspective view of the portable building without a roof.
Figure 3:
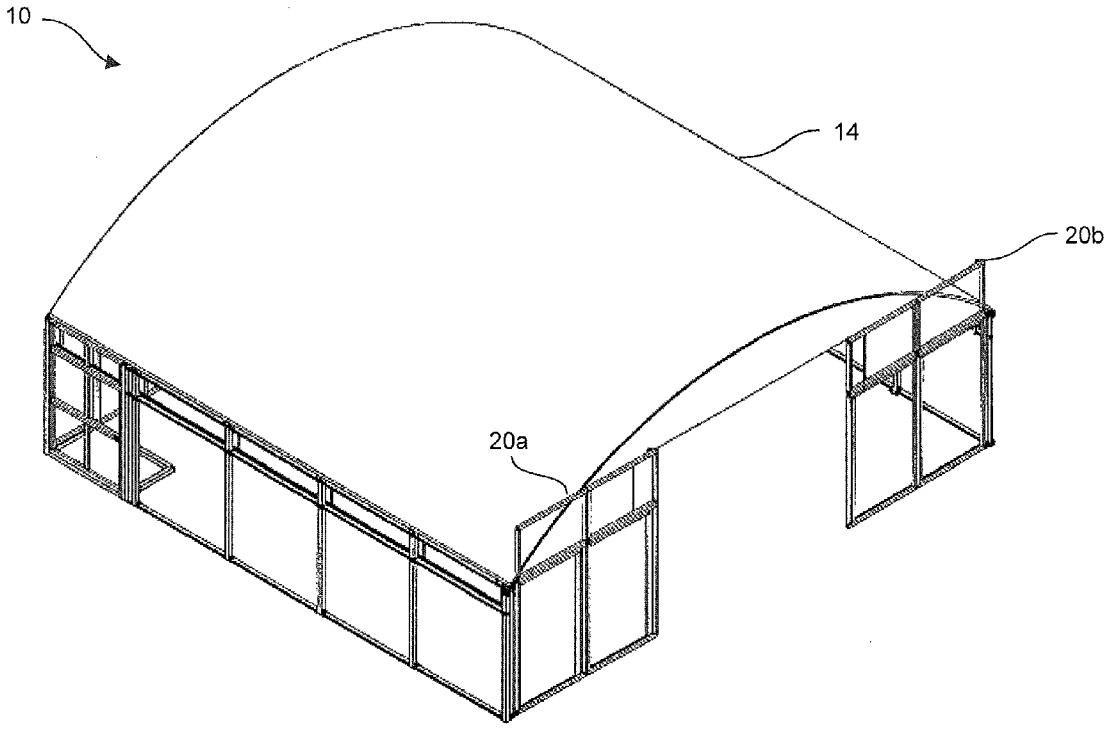
FIG. 3 is a perspective view of the portable building with the access doors open.

Turning to FIG. 2, a perspective view of the portable building 10 without a roof is shown. The frame 12 of the portable building 10 includes a set of four walls 16 including a front wall 16*a*, a first side wall 16*b*, a second side wall 16*c* and a rear wall 16*d*. Within the front wall 16*a* is an access door 18. The access door 18 includes a pair of inner doors 20*a* and 20*b* which slide outwards towards their respective side walls 16*b* and 16*c* from a closed position to an open position. The front wall 16*a* further includes a pair of outer doors 22*a* and 22*b* which have a folding mechanism, such as a hinge or pivot, intermediate their associated side walls 16*b* or 16*c* such that they may be rotated open. As illustrated in FIG. 3, the inner doors 20*a* and 20*b* may be opened independent of whether the outer doors 22*a* and 22*b* are opened.

In some cases, the walls 16*a*, 16*b*, 16*c* and 16*d* will be metal framed panels but any suitable framing structure may be used; for example, wood frames, plastic frames, and the like. Although not shown, the walls 16*a*, 16*b*, 16*c* and 16*d* may include any type of suitable siding or cladding; for example, fabric, metal sheathing, plastic sheathing, wooden sheathing, shingles, brick, stone, imitation brick or stone, or the like. The walls 16*a*, 16*b*, 16*c* and 16*d* and roof 14 may be insulated to facilitate the use of the building in inclement weather and harsh environments.

The frame 12 further includes a set of sliding roof trusses 24 for supporting the roof when it is installed. In one embodiment, the walls 16*a*, 16*b*, 16*c* and 16*d* may be integrated with roof trusses 24 or they may be separate parts. In a preferred case, the sliding roof trusses 24 may be made of bent steel tubing constructed of a double truss with a steel substructure. At one end of the set of sliding roof trusses 24 (namely the end near the front wall 16*a*), the set of sliding roof trusses includes a sliding truss with a gable end 25*a* and at the opposite end (namely the end near the rear wall 16*d*), the set of sliding roof trusses 24 includes a sliding truss with a gable end 25*b*. In a preferred embodiment, each of the sliding roof trusses 24 is attached at either end to one of the side walls 16*b* and 16*c*. The frame 12 preferably includes a pair of sliding mechanisms (not shown) over which the sliding roof trusses 24 may move in a direction perpendicular to the face of the side walls 16*b* and 16*c* so that the sliding roof trusses 24 can be slid between the rear wall 16*d* and the front wall 16*a*. When the sliding roof trusses 24 are dispersed along the length of the frame 12, the sliding roof trusses 24 are in a dispersed state.

The first side wall 16*b* includes a first hinged wall section 28*a* which has a folding mechanism, such as a hinge or pivot, intermediate a first end section 32*a*. As well, the second side wall 16*c* also includes a hinged wall section 28*b* which has a folding mechanism, such as a hinge or pivot, intermediate a second end section 32*b*.

FIG. 3 is another perspective view of the portable building 10, shown with a roof 14. In this figure, the pair of inner doors 20*a* and 20*b* of the access door 18 are open and have been slid to a position adjacent the pair of outer doors 22*a* and 22*b*. In other cases, other door designs may be employed; for example, a hinged door, a rotating door, or the like.

The roof 14 is installed on the top of the portable building 10 and is supported by the sliding roof trusses 24. In a preferred case, the roof 14 is made of fabric material that is unrolled from rollers and winched up over the portable building 10. Multiple sections of roof material may be used so that each section of roof 14 material can be easily handled by two people. An overlap between sections of roof 14 may be used to ensure that the roof 14 protects against weather elements. In another embodiment, individual pieces of fabric may be attached to each of the sliding roof trusses in single panels such that the panels fold as the sliding roof trusses are slid together.

FIGS. 4-11 illustrate stages for preparing, folding and collapsing the portable building 10 for transport, according to an embodiment.

Figure 4:
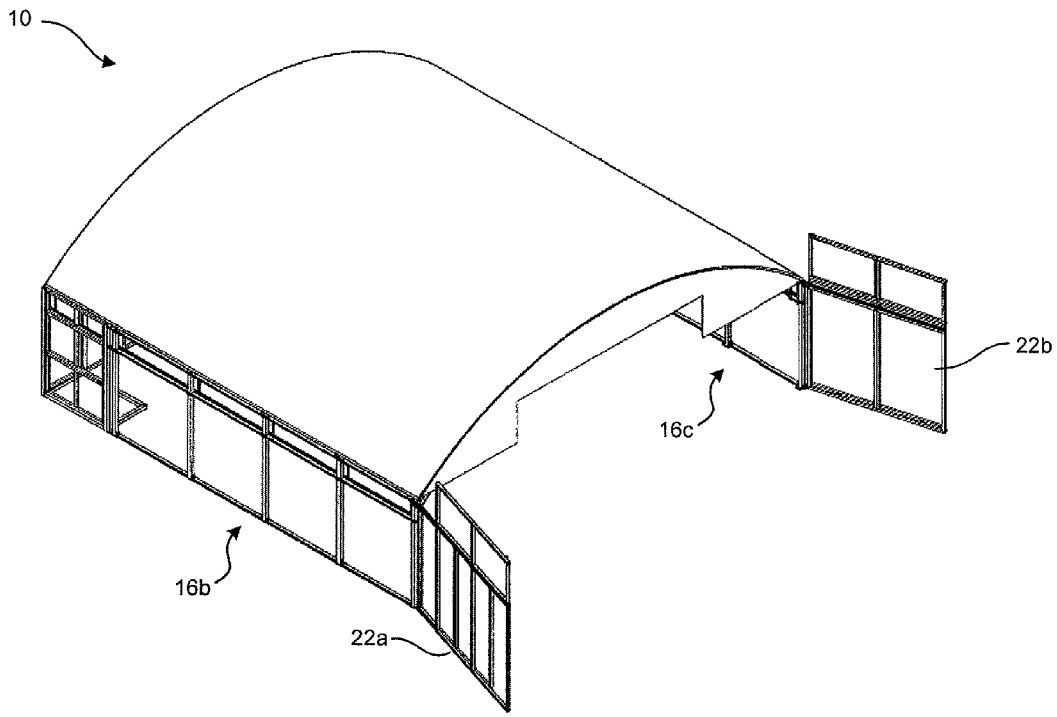
FIG. 4 is a perspective view of the portable building with the doors partially rotated back.

Turning to FIG. 4, a perspective view of the portable building 10 is shown. As in FIG. 3, the pair of inner doors 20*a* and 20*b* of the access door 18 are open and have slid to a position adjacent the pair of outer doors 22*a* and 22*b*. The outer doors 22*a* and 22*b* (along with the inner doors 20*a* and 20*b*) are outwardly rotated about the folding mechanism with respect to their associated side walls 16*b* or 16*c*. This further open door position may also be used when a larger opening to the portable building 10 is desired. For instance in use for the storage of aircraft or large off-highway equipment such as, but not limited to airport snowplows.

Figure 5:
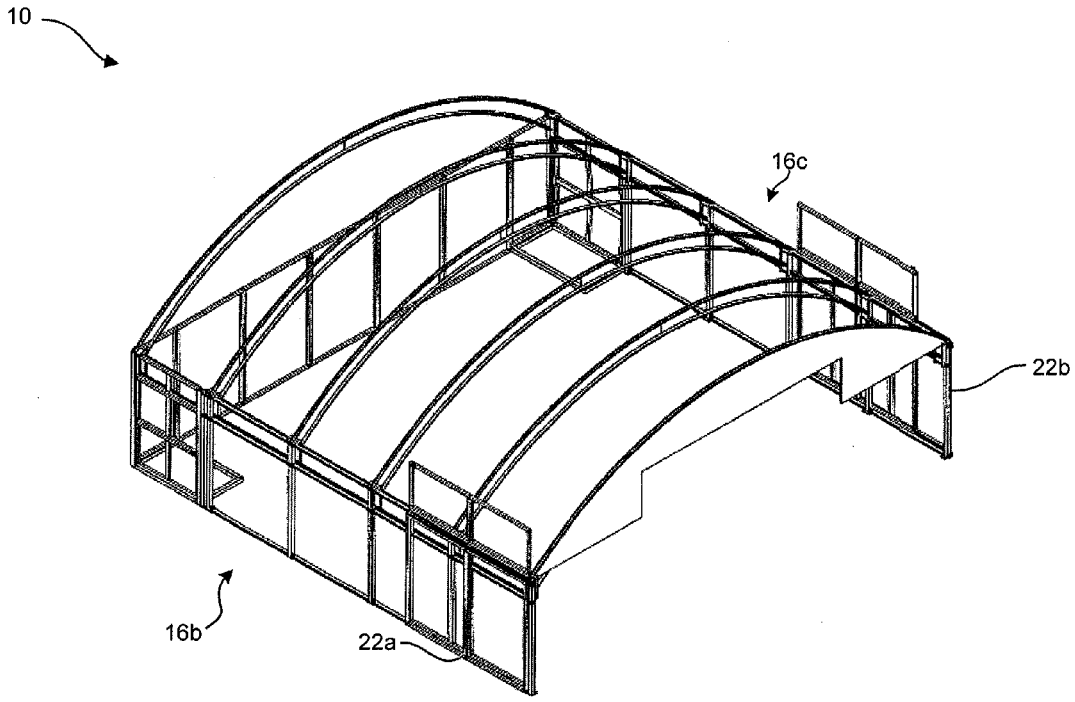
FIG. 5 is a perspective view of the portable building with the doors rotated back.

Turning to FIG. 5, another perspective view of the portable building 10 is shown. The outer doors 22*a* and 22*b* have been fully outwardly rotated such that they abut the outside of their associated side walls 16*b* and 16*c*. Folding the outer doors 22*a* and 22*b* out of the way may permit easier access for sliding the set of sliding roof trusses 24 as described below. The roof 14 is removed from the sliding roof trusses 24. Removal may include, for example, folding the roof between the sliding roof trusses or sliding the roof off in one piece or separate pieces.

Figure 6:
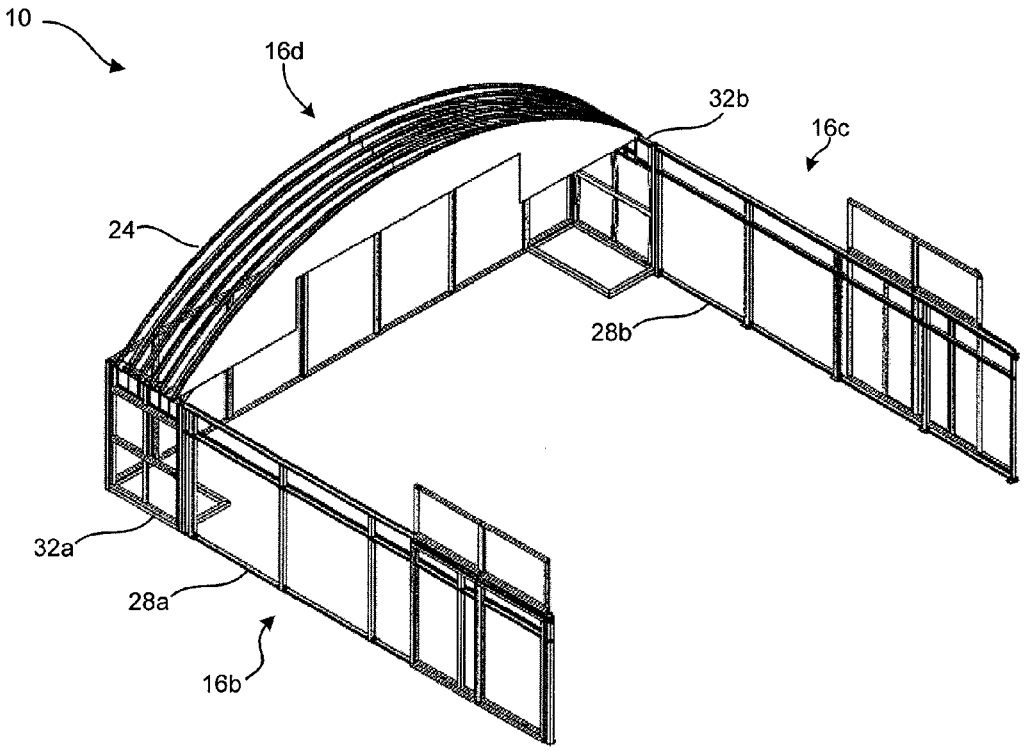
FIG. 6 is a perspective view of the portable building with the sliding roof trusses in a collapsed state.

Turning to FIG. 6, another perspective view of the portable building 10 is shown. The sliding roof trusses 24, having been slid along the pair of sliding mechanisms (not shown) on the side walls 16*b* and 16*c* towards the rear wall 16*d*, are in a collapsed state. In the collapsed state, the sliding roof trusses 24 abut each other and the rear wall 16*d*. As the sliding roof trusses 24 only occupy the part of the sliding track on the first end section 32*a* of the first side wall 16*b* and on the second end section 32*b* of the second side wall 16*c*, the first hinged wall section 28*a* and the second hinged wall section 28*b* of the respective side walls 16*b* and 16*c* are not constrained and may be folded.

Figure 7:
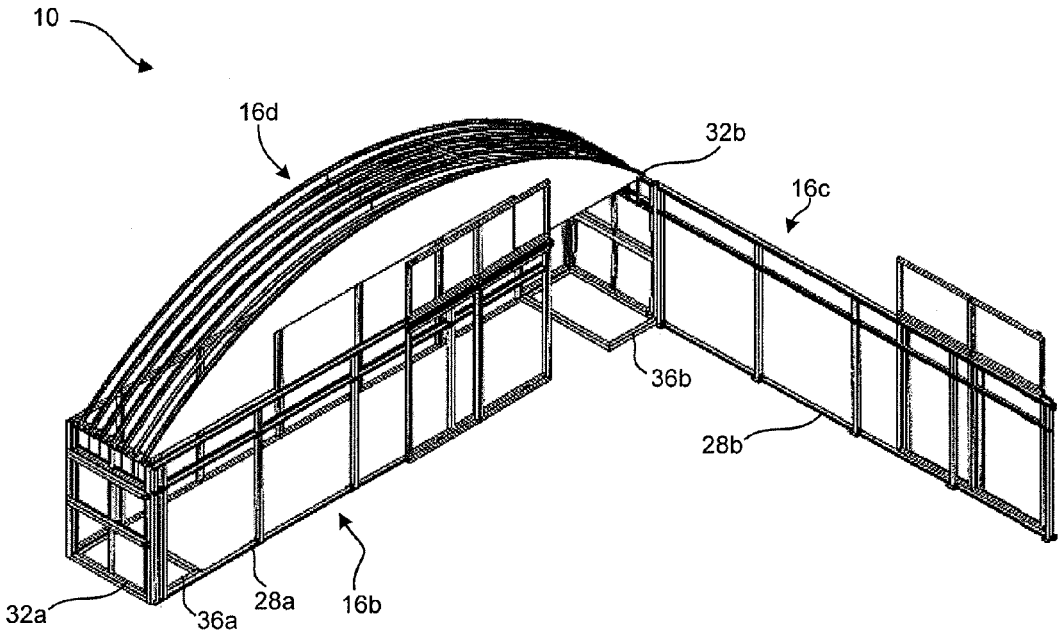
FIG. 7 is a perspective view of the portable building with one side wall folded for transport.

Turning to FIG. 7, another perspective view of the portable building 10 is shown. The portable building 10 is shown in a folded state. The first hinged wall section 28*a* of the first side wall 16*b* has a folding mechanism, such as a hinge or pivot, intermediate the first end section 32*a*. In the first folded state, the first hinged wall section 28*a* may be folded inwards towards the rear wall 16*d* until the first hinged wall section 28*a* is approximately perpendicular to the first end section 32*a*.

In some cases, the first end section 32*a* may have a floor brace 36*a* attached to it. The floor brace 36*a* may extend perpendicular to the face of the first end section 32*a*. The floor brace 36*a* may generally rest on the floor underneath the portable building 10, may have a generally rectangular shape and be located on the inside side of the first end section 32*a*. In the same way, the second end section 32*b* may also have a floor brace 36*b* attached to it. The floor braces 36*a* and 36*b* may be designed and proportioned to support the side walls 16*b* and 16*c*, and specifically the end sections 32*a* and 32*b*, so that they are unable to collapse inward due to the weight of the side walls 16*b* and 16*c*, the roof 14 and other elements of the portable building 10. In other cases, the floor braces 36*a* and 36*b* may also, or only, be attached to the rear wall 16*d*. In still other cases, there may be further floor braces located on the inside or outside of any of the walls 16*a*, 16*b*, 16*c* or 16*d* as required for structural integrity of the portable building 10.

Figure 8:
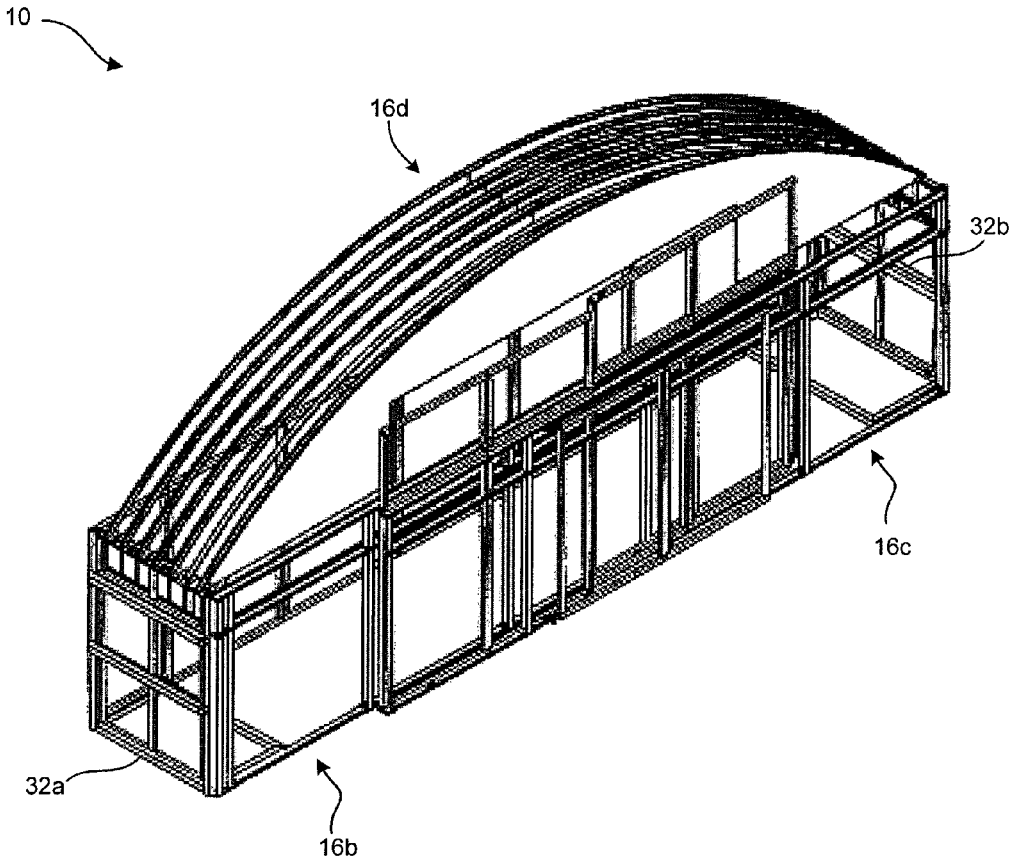
FIG. 8 is a perspective view of the portable building with both side walls folded for transport.

Turning to FIG. 8, another perspective view of the portable building 10 is shown. The portable building 10 is shown in a second folded state. The second hinged wall section 28*b* of the second side wall 16*c* has a folding mechanism, such as a hinge or pivot, intermediate the second end section 32*b*. In the second folded state, the second hinged wall section 28*b* may be folded inwards towards the rear wall 16*d* until the second hinged wall section 28*b* is approximately perpendicular to the second end section 32*b* and abutting the first hinged wall section 28*a*. With both the hinged wall sections 28 and 28*b* folded inwards, the portable building 10 may be in a state of minimum footprint and ready to be transported pending lowering of the frame of the roof. In a particular case, the portable building 10 can be transported without lowering the roof where height restrictions and a lower center of gravity are not a concern. As well, in some cases, the rear wall 16*d*, the front wall 16*a*, or both, may be fastened to the portable building 10 such that they may be removed prior to transport or to allow a plurality of portable buildings to be fastened together back-to-back to produce a larger building, possibly with doors on both ends.

FIGS. 9-11 illustrate stages for lowering the set of roof trusses 24 for transport, according to an embodiment.

Figures 9A, 9B, 9C:
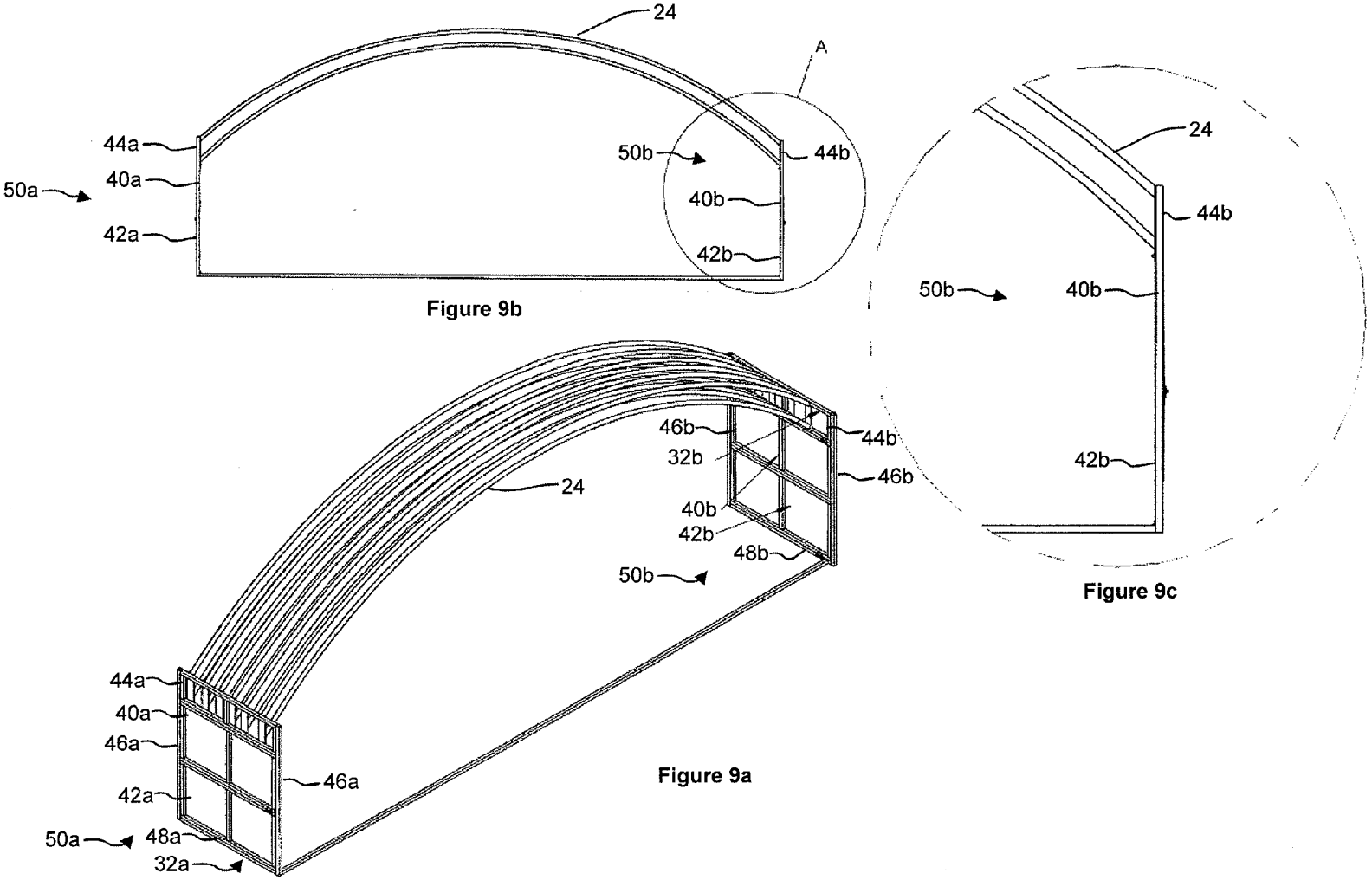
FIG. 9*a* is a partial-cutaway perspective view of the end sections with fully raised sliding roof trusses.
FIG. 9*b* is a partial-cutaway side view of the end sections with fully raised sliding roof trusses.
FIG. 9*c* is an enlarged view of the end sections with fully raised sliding roof trusses.

FIG. 9A illustrates a partial-cutaway perspective view of the end sections 32*a* and 32*b* and the sliding roof trusses 24 which are in a fully-raised collapsed state. FIG. 9B illustrates a side view of the end sections 32*a* and 32*b* and the sliding roof trusses 24. FIG. 9C illustrates an enlarged side view of the region labeled A in FIG. 9B. The first end section 32*a* includes a first roof truss elevating apparatus 50*a*. The first roof truss elevating apparatus 50*a* includes a first upper link 40*a*, a first lower link 42*a*, a first truss link 44*a*, first side members 46*a* and a first lower member 48*a*. Similarly, the second end section 32*b* includes a second roof truss elevating apparatus 50*b*. The second roof truss elevating apparatus 50*b* includes a second upper link 40*b*, a second lower link 42*b*, a second truss link 44*b*, second side members 46*b* and a second lower member 48*b*. In a preferred case, the upper links 40*a* and 40*b* are equally dimensioned with the lower links 42*a* and 42*b*.

The truss links 44*a* and 44*b* have a folding mechanism, such as a hinge or pivot, intermediate their respective upper links 40*a* and 40*b*. The upper links 40*a* and 40*b* have a folding mechanism, such as a hinge or pivot, intermediate their respective lower links 42*a* and 42*b*. The lower links 42*a* and 42*b* have a folding mechanism, such as a hinge or pivot, intermediate their respective lower members 48*a* and 48*b*.

The truss links 44*a* and 44*b* include the sliding mechanism on which the ends of the sliding roof trusses 24 have been slid to when the sliding roof trusses 24 are in the collapsed state. The truss links 44*a* and 44*b* are themselves slidably mounted in the vertical direction within their respective side members 46*a* and 46*b*, by, for example, slides, rails, channels, or the like. The sliding roof trusses 24 are fully-raised when the truss links 44*a* and 44*b* are at the top of their respective side members 46*a* and 46*b*.

In further embodiments, the roof truss elevating apparatuses may include any apparatus that is capable of raising and lowering the sliding roof trusses 24; for example, a rope and pulley system, a hydraulic actuator, and the like.

While scissor-type mechanisms are shown as the folding mechanism, it will be understood that other folding mechanisms, such as, but not limited to, single bar or other type of linkage mechanisms are contemplated.

Figures 10A, 10B, 10C:
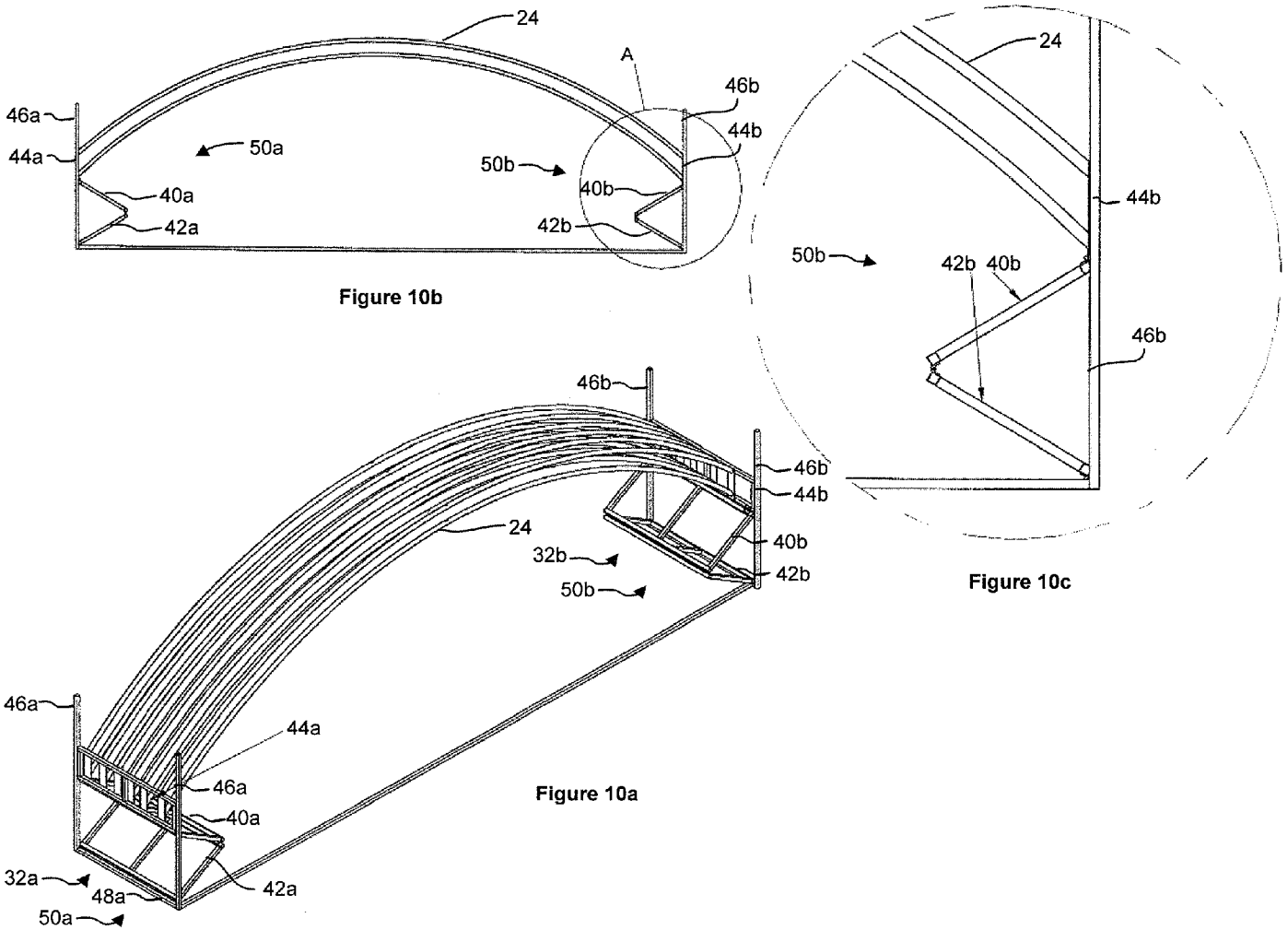
FIG. 10*a* is a partial-cutaway perspective view of the end sections with partially raised sliding roof trusses.
FIG. 10*b* is a partial-cutaway side view of the end sections with partially raised sliding roof trusses.
FIG. 10*c* is an enlarged view of the end sections with partially raised sliding roof trusses.

FIG. 10A illustrates a partial-cutaway perspective view of the end sections 32*a* and 32*b* and the sliding roof trusses 24 which are in a partially-raised collapsed state. FIG. 10B illustrates a side view of the end sections 32*a* and 32*b* and the sliding roof trusses 24. FIG. 10C illustrates an enlarged side view of the region labeled A in FIG. 10B. When the sliding roof trusses 24 are partially-raised, the upper links 40*a* and 40*b* and the lower links 42*a* and 42*b* fold inwards and form a triangular shape with their respective side members 46*a* and 46*b*. The vertices of the triangle being the three points with folding mechanisms as stated earlier. As the sliding roof trusses 24 are lowered further, the angle between the upper links 40*a* and 40*b* and the lower links 42*a* and 42*b* gets smaller. As well, as the sliding roof trusses 24 are lowered, the truss links 44*a* and 44*b* slide down their respective side members 46*a* and 46*b*. The sliding roof trusses 24 may be raised and lowered manually, such as with a winch and hand crank, or motorized, such as with a hydraulic lift or crane.

Figure 11C:
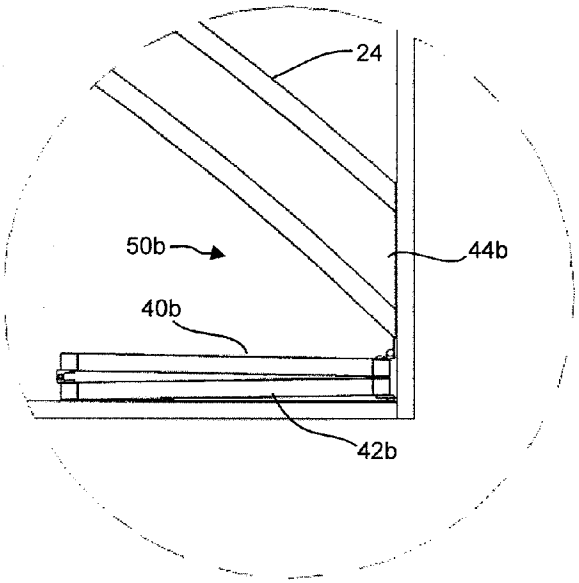
FIG. 11*c* is an enlarged view of the end sections with fully lowered sliding roof trusses.
Figure 11B:
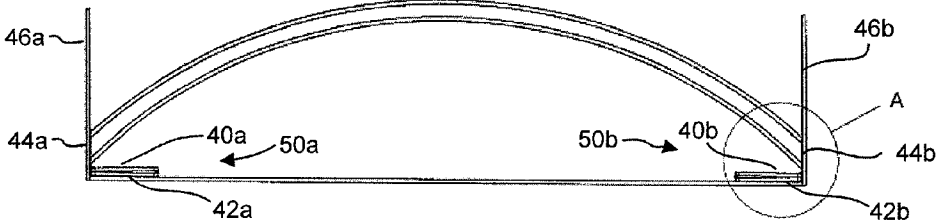
FIG. 11*b* is a partial-cutaway side view of the end sections with fully lowered sliding roof trusses.
Figure 11A:
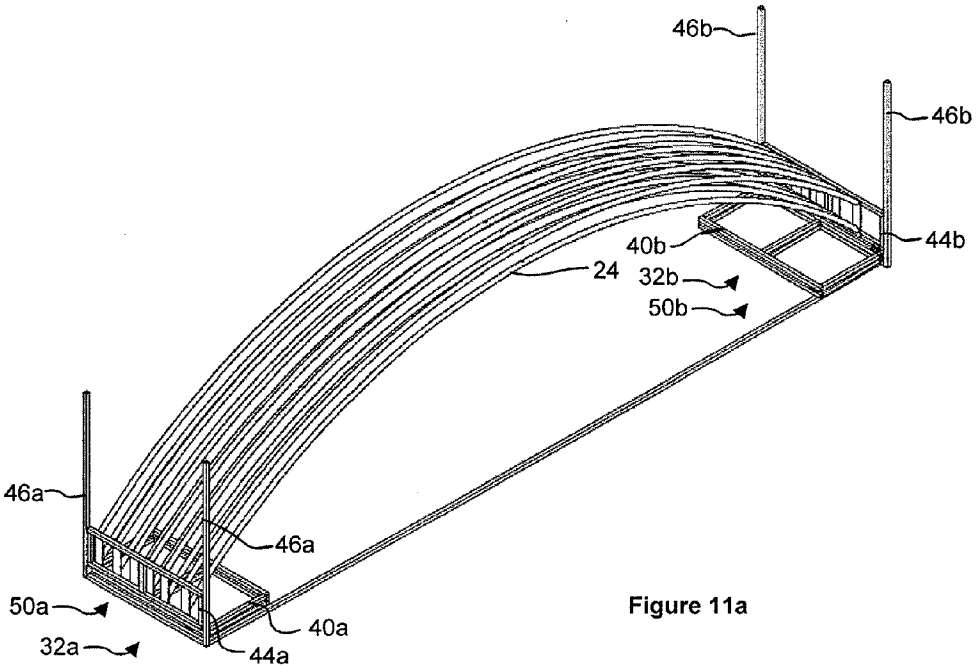
FIG. 11*a* is a partial-cutaway perspective view of the end sections with fully lowered sliding roof trusses.

FIG. 11A illustrates a partial-cutaway perspective view of the end sections 32*a* and 32*b* and the sliding roof trusses 24 which are in a fully-lowered collapsed state. FIG. 11B illustrates a side view of the end sections 32*a* and 32*b* and the sliding roof trusses 24. FIG. 11C illustrates an enlarged side view of the region labeled A in FIG. 11B. When the sliding roof trusses 24 are fully-lowered, the upper links 40*a* and 40*b* and the lower links 42*a* and 42*b* are approximately horizontal and the truss links 44*a* and 44*b* cannot slide down any further. In the collapsed state, the sliding roof trusses 24 are arranged for transport as the height of the sliding roof trusses 24 is preferably designed to fit in the storage area of a transport truck, or where it is on an open-bed truck or pulled on a trailer, to fit under highway overpasses. As well, the lowered sliding roof trusses 24 will allow for a lower center of gravity and therefore a more stable arrangement for transport.

Figure 12:
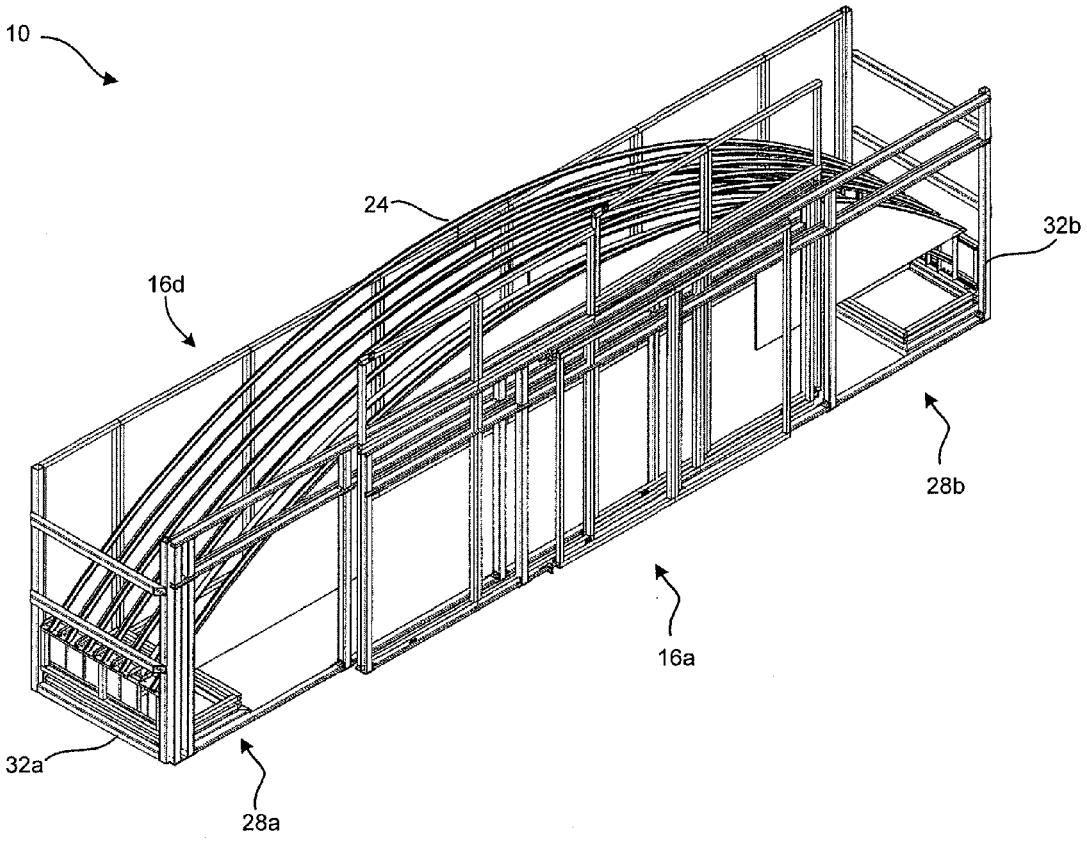
FIG. 12 is a perspective view of the portable building in a transport condition.

FIG. 12 illustrates a perspective view of the portable building 10 in a transport condition such that it is arranged for transport. The front wall 16*a* and the hinged wall sections 28*a* and 28*b* are folded at the front of the portable building 10. The sliding roof trusses 24 are lowered such that the top of the sliding roof trusses 24 are approximately at the same height as the height of the walls 16*a*, 16*b*, 16*c* and 16*d*. Thus, the portable building 10 is in a state that facilitates transport by, for example, truck, trailer or the like. In a particular case, the portable building 10 arranged for transport is dimensioned such that it can fit on a conventional open trailer. In a further case, the portable building 10 arranged for transport is dimensioned such that it can fit into a conventional shipping container or conventional semi-trailer truck.

Figure 13:
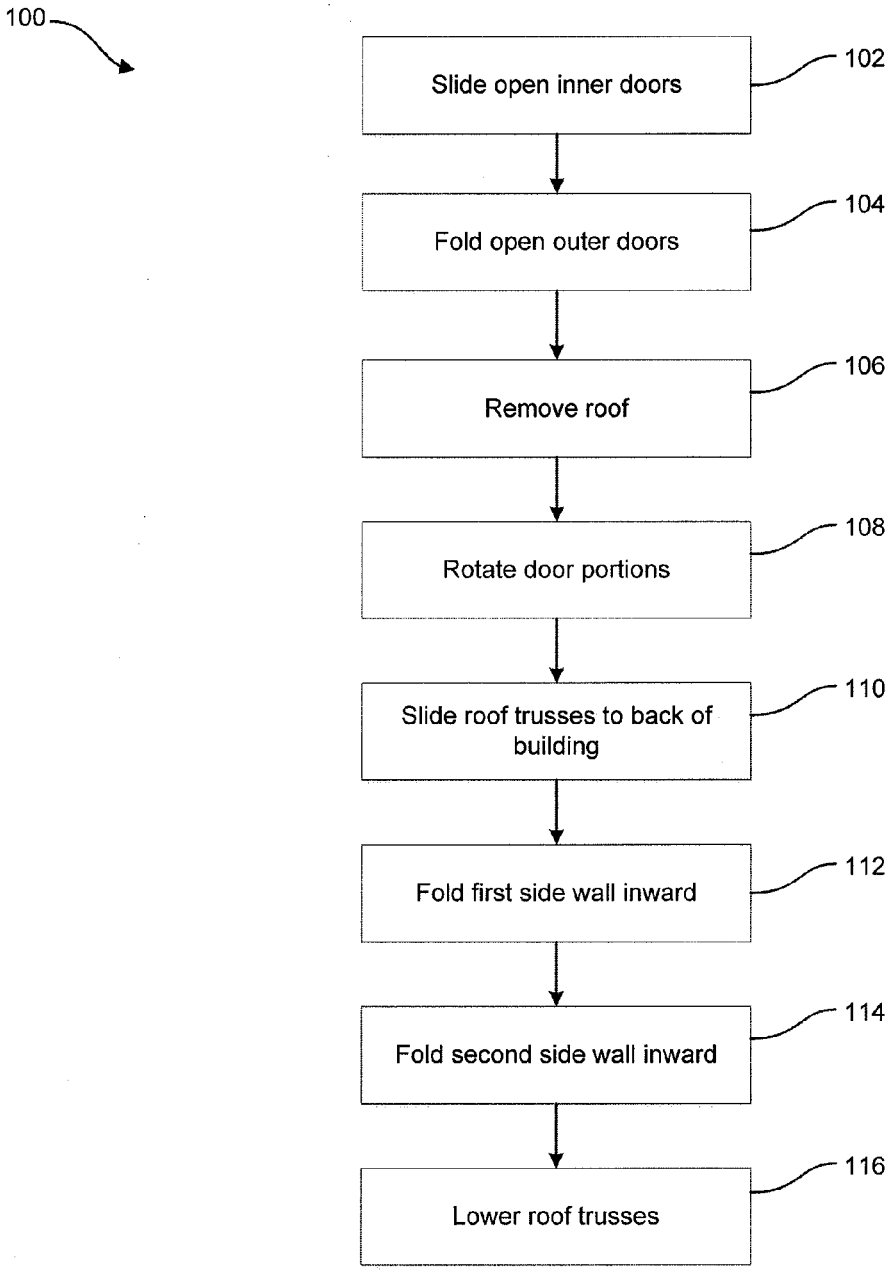
FIG. 13 is a flowchart for a method of collapsing a portable building for transport according to an embodiment.

Turning to FIG. 13, a flowchart outlining a method 100 of collapsing a portable building 10 for transport is shown. Prior to the method being performed, it is assumed that the portable building 10 is in an assembled condition having been fully erected, all doors closed, and sliding roof trusses 24 in a fully-raised dispersed state with a roof covering.

Initially, the access door is fully opened 102. This is accomplished by sliding each of the pair of inner doors 20*a* and 20*b* outward from their closed position to their opened position. In their opened positions, the pair of inner doors 20*a* and 20*b* are adjacent the pair of outer doors 22*a* and 22*b*. This is schematically shown in FIG. 3.

The front wall 16*a* (formed by the access door 18 and the outer doors 22*a* and 22*b*) is removed 104. In other words, the outer doors 22*a* and 22*b* are opened up via a folding mechanism and rotated towards their respective side walls 16*b* and 16*c*. This is schematically shown in FIG. 4. The roof is then removed 106.

In one embodiment, the roof is a single piece of fabric that is removed from covering the sliding roof trusses such as like a tarp. In another embodiment, the sliding roof trusses include fastening tracks so that that each roof truss may be attached to an individual panel of fabric such that when the trusses are slid back, the fabric will naturally fold between the trusses. In this manner, the roof does not have to be handled separately and the roof is not removed but folded up.

The outer doors 22*a* and 22*b* are then fully rotated 108 back alongside their respective side walls 16*b* and 16*c*. By rotating the door portions back to be parallel with the side walls 16*b* and 16*c*, this allows the side walls 16*b* and 16*c* of the portable building 10 to be folded. This position is schematically shown in FIG. 5.

The sliding roof trusses 24 are then slid 110 back towards the rear wall 16*d*. As understood, the sliding roof trusses 24 are preferably connected on a sliding mechanism (not shown) which allows the sliding roof trusses 24 to be easily slid along the frame 12 to be collected near the rear wall 16*d*. This is schematically shown in FIG. 6.

One of the side walls, 16*b* or 16*c*, is then folded 112. As the side walls are attached to a folding mechanism, as discussed above with respect to FIG. 2, one of the side walls 16*b* or 16*c*, is folded in towards the rear wall 16*d* and is then aligned with the rear wall 16*d*. This is schematically shown in FIG. 7.

The other side wall, 16*b* or 16*c*, is then folded in 114. As with the other side wall, this side wall, 16*b* or 16*c*, is fold in toward the rear wall 16*d* along the folding mechanism. This is schematically shown in FIG. 8.

The sliding roof trusses 24 are then lowered 116 using the roof truss elevating apparatuses 50*a* and 50*b*. The upper links 40*a* and 40*b* and the lower links 42*a* and 42*b* are folded inwards such that the truss links 44*a* and 44*b* slide down their respective side members 46*a* and 46*b*. The sliding roof trusses 24 may be raised and lowered manually, such as with a winch and hand crank, or motorized, such as with a hydraulic lift or crane. The sliding roof trusses 24 are fully lowered when the upper links 40*a* and 40*b* and the lower links 42*a* and 42*b* are approximately horizontal and the truss links 44*a* and 44*b* cannot slide down any further. This is schematically shown in FIGS. 9-11. With the sliding roof trusses 24 fully lowered, the portable building 10 is in a transport condition and is ready to be transported.

For setting up the portable housing after transport, the method of FIG. 13 may be reversed. In some cases, the method of FIG. 13 may be undertaken in a different order, such as lowering the sliding roof trusses 24 prior to folding the side walls 16*b* and 16*c*.

The portable building 10 may be used for shelter and protection of equipment, warehouse items, mobile equipment, aircraft, archaeological sites, crime scenes and other uses where a clear span, rapidly deployed structure is required. The portable building 10 may be designed and dimensioned to be transportable on public roads and easily unfolded and erected by a minimum crew. In one case, in the transport condition, the building may be folded to approximately the size of a highway tractor trailer. Either a trailer or a mounted axle assembly and hitch mounted to the structure may be employed to allow the building to be transported.

The walls of the structure may be clad to provide security. The roof material is preferably made of fabric to allow light passage, rapid erection, and venting to prevent fire spread; however, the roof may be made of any suitable material, for example, metal, plastic, nylon, wood, or the like.

In a particular case, the building is used as an aircraft hangar for personal aircraft. The portable building 10 may also be: a rapidly erected portable building 10 used for emergency response to natural disasters, environmental spills, and crime scenes; a rapidly deployable portable building 10 for military related needs, defense related needs, and international aid; a portable workshop and secure storage for construction projects; a portable storage for cottage owners, homeowners, farmers, and temporary commercial requirements; and the like. In the case of an aircraft hangar, slots may be provided in the side walls 16*b* and 16*c* so that the wings of a high wing aircraft can protrude from the building.

In a further embodiment, the portable building 10 system may include a trailer section (not shown) upon which the portable building 10 is mounted. In certain cases, a fifth wheel hitch may allow it to be towed as a legal trailer without oversize transport permits in North America; for example, when in a transport condition, the trailer may be about 8 feet wide, about 13 feet high and about 42 feet long. The trailer hitch and/or wheels may be included with the system or optionally added later.

The portable building 10 in the disclosure allows for a portable building with a compact transport condition that also has ease of assembly such that it can be erected relatively quickly. In some cases, the building may be erected by two people in approximately two hours and may extend to 42 feet wide and 32 feet long or 40 feet long. The ease of assembly of the portable building 10 may mitigate possible mistakes in assembly, and therefore may alleviate many safety concerns that are likely present in a portable building with a complex assembly.

Multiple portable buildings 10 may be fastened together to make one longer building of multiple lengths. The door may provide a 40 feet clear span with a height of 10 feet and a center height of 16 feet for 20 feet. Buildings may also be fastened together to achieve a door at either end. In a further embodiment, the inner doors 20*a* and 20*b* may be located in the end wall.

The measurements stated in the disclosure are examples only and not meant to be limiting in scope.

In the preceding description, for purposes of explanation, numerous details are set forth in order to provide a thorough understanding of the embodiments. However, it will be apparent to one skilled in the art that these specific details are not required. In other instances, well-known structures are shown in block diagram form in order not to obscure the understanding. The above-described embodiments are intended to be examples only. Alterations, modifications and variations can be effected to the particular embodiments by those of skill in the art without departing from the scope, which is defined solely by the claims appended hereto.

What is claimed is:

1. A portable building able to transition between a collapsed transport condition and an assembled condition, the portable building comprising:

a rear wall;

a first side wall and a second side wall attached to the rear wall, each of the side walls comprising:

a hinged wall section, an end section, a side folding mechanism intermediate the hinged wall section and the end section for folding the hinged wall section along the end section;

a front wall comprising a pair of outer doors;

a pair of front folding mechanisms each front folding mechanism intermediate one of the pair of outer doors and the first or second side wall for folding each outer door along the first or second side wall;

a plurality of sliding roof trusses slidably engaged with the first side wall and the second side wall such that the plurality of sliding roof trusses can slide from a dispersed state along the first or second side wall to a collapsed state; and a roof mounted over at least a portion of the plurality of sliding roof trusses;

a pair of roof truss elevating apparatuses disposed at the end sections for raising and lowering the sliding roof trusses;

wherein the roof truss elevating apparatus comprises:

a truss link for retaining ends of the sliding roof trusses;

an upper link in a hinged relationship with the truss link;

a lower link in a hinged relationship with the truss link;

a lower member in a hinged relationship with the lower link; and a pair of side members connected transversely to the lower member, wherein the truss link is slidably mounted within the pair of side members and the upper link and lower link fold to raise and lower the sliding roof trusses.

2. The portable building of claim 1, the portable building in the collapsed transport condition dimensioned to fit on a trailer.

3. The portable building of claim 1, the portable building in the collapsed transport condition dimensioned to fit in a shipping container.

4. The portable building of claim 1, the front wall further comprising a pair of inner doors whereby the inner doors are openable independent of the outer doors.

5. The portable building of claim 4, the pair of inner doors being slidably mounted to the outer doors.

6. The portable building of claim 1 further comprising a gable end attached to at least one of the sliding roof trusses.

7. The portable building of claim 1 further comprising at least two floor braces each mounted on one of the walls of the portable building, extending perpendicular to a face of the wall that the at least two floor braces are mounted, for supporting the wall.

* * * * *